US008118392B2

(12) United States Patent
Groenenboom et al.

(10) Patent No.: US 8,118,392 B2
(45) Date of Patent: Feb. 21, 2012

(54) MOVABLE WEB SUPPORT AND CAP

(75) Inventors: Mark D. Groenenboom, Vancouver, WA (US); Antonio Gomez, Vancouver, WA (US); Tanya V. Burmeister, Vancouver, WA (US); Stephanie L. Seaman, Portland, OR (US); Russell P. Yearout, Brush Prairie, WA (US); Angela Chen Krauskopf, Camas, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 693 days.

(21) Appl. No.: 12/200,925

(22) Filed: Aug. 28, 2008

(65) Prior Publication Data

US 2010/0053259 A1 Mar. 4, 2010

(51) Int. Cl.
*B41J 2/165* (2006.01)

(52) U.S. Cl. ..... 347/22; 347/29; 347/33

(58) Field of Classification Search ..... 347/22–23, 347/33, 29

See application file for complete search history.

(56) References Cited

U.S. PATENT DOCUMENTS

| | | | | |
|---|---|---|---|---|
| 5,805,191 | A * | 9/1998 | Jones et al. | 347/103 |
| 6,189,998 | B1 | 2/2001 | Yanagi et al. | |
| 6,474,774 | B1 | 11/2002 | Okamoto | |
| 6,520,621 | B1 | 2/2003 | Eckard et al. | |
| 6,561,619 | B1 | 5/2003 | Shibata et al. | |
| 7,229,149 | B2 * | 6/2007 | Wotton et al. | 347/33 |
| 7,246,556 | B1 | 7/2007 | Stoneberg et al. | |
| 7,316,466 | B2 | 1/2008 | Uwagaki et al. | |
| 7,828,407 | B2 * | 11/2010 | Gomez et al. | 347/22 |
| 2004/0080563 | A1 | 4/2004 | Leemhuis | |
| 2006/0209152 | A1 * | 9/2006 | Baringa et al. | 347/104 |
| 2006/0266239 | A1 | 11/2006 | Yip | |
| 2007/0046724 | A1 | 3/2007 | Jung et al. | |
| 2007/0242121 | A1 | 10/2007 | Kersey et al. | |
| 2008/0024550 | A1 | 1/2008 | Miyazawa | |

FOREIGN PATENT DOCUMENTS

| | | |
|---|---|---|
| JP | 404131249 | 5/1992 |
| JP | 406071904 | 3/1994 |

* cited by examiner

*Primary Examiner* — Jason Uhlenhake

(57) ABSTRACT

A method and apparatus raise and lower a web support and move a cap over and above the web support.

15 Claims, 11 Drawing Sheets

MOVABLE WEB SUPPORT AND CAP

CROSS-REFERENCE TO RELATED PATENT APPLICATIONS

The present application is related to co-pending U.S. patent application Ser. No. 12/200,927 filed on the same date herewith by Tanya V. Burmeister, Antonio Gomez and Mark D. Groenenboom and entitled WEB, the full disclosure of which is incorporated by reference.

BACKGROUND

Print head servicing stations sometimes include webs and caps for servicing the print heads. Size objectives sometimes limit a size of the web, necessitating more frequent and costly replacement of the web.

DETAILED DESCRIPTION OF THE EXAMPLE EMBODIMENTS

Figure 1:
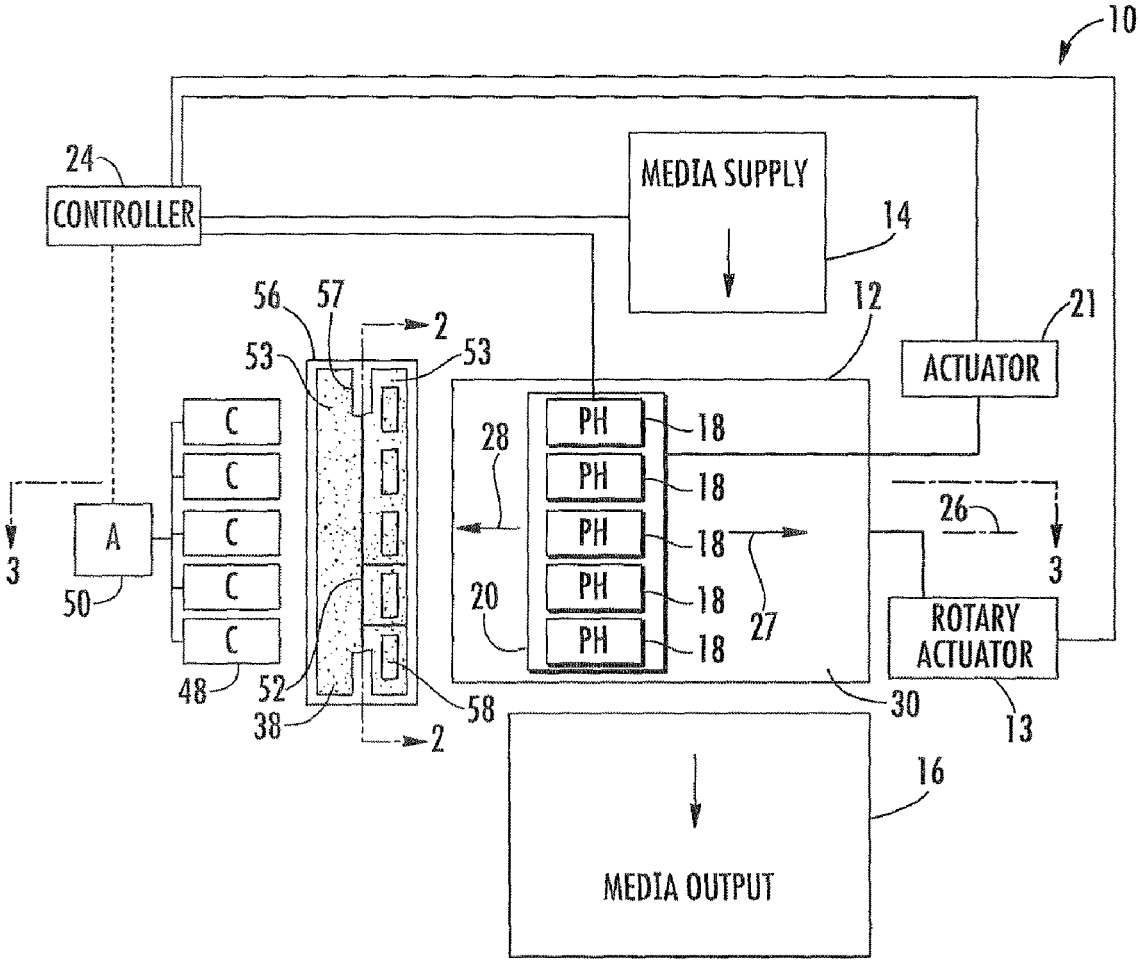
FIG. 1 is a schematic illustration of a printing system according to an example embodiment.
Figure 2:
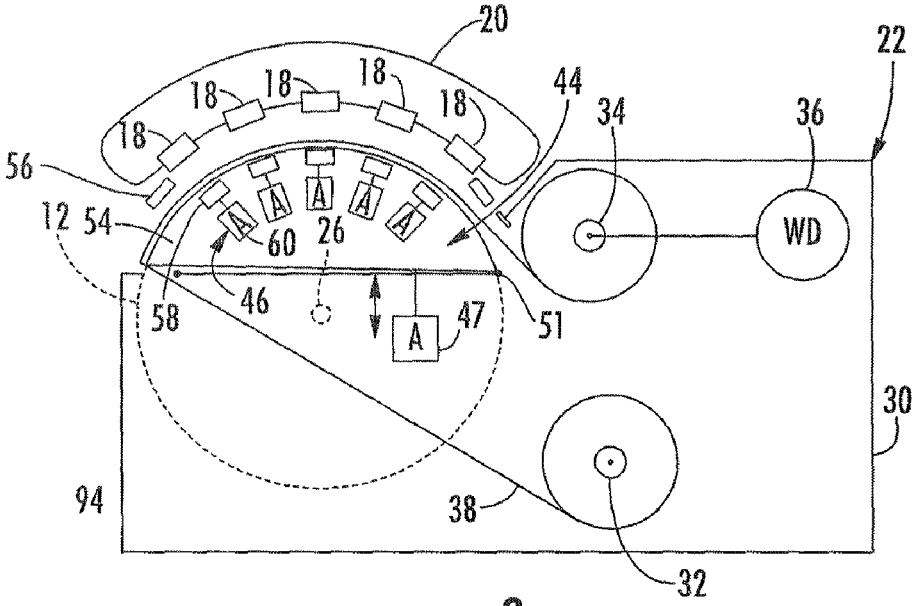
FIG. 2 is a sectional view of the printing system of FIG. 1 taken along line 2-2 according to an example embodiment.
Figure 3:
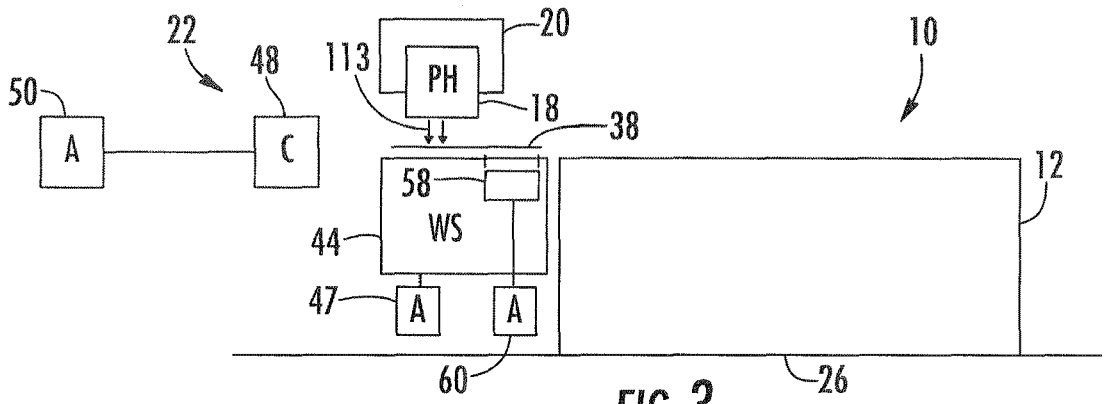
FIG. 3 is a sectional view of the printing system of FIG. 1 taken along line 3-3 illustrating ejection of fluid onto a web according to an example embodiment.

FIGS. 1-3 schematically illustrate printing system 10 according to one exemplary embodiment. Printing system 10 generally includes drum 12, rotary actuator 13, media supply 14, media output 16, print heads 18, carriage 20, actuator 21, service station 22 and controller 24. Drum 12 generally comprises an elongated cylinder configured to be rotationally driven about axis 26 by rotary actuator 13 while transporting media, such as paper, about axis 26 relative to print heads 18. Rotary actuator 13 comprises a source of torque, such as a motor, operably coupled to drum 12 by a transmission (not shown).

Media supply 14, schematically shown, comprises a mechanism configured to supply media to drum 12. In one embodiment, media supply 14 comprises a mechanism configured to pick an individual sheet of media from a stack of media and to supply the individual sheet to drum 12 such that the sheet is wrapped at least partially about drum 12. Media output 16, schematically shown, comprises a mechanism to withdraw printed upon media from drum 12 and to transport withdrawn media to and contain withdrawn media within an output tray, bin or the like.

Print heads 18 comprise devices configured to dispense imaging material or fluid, such as ink, upon the medium held by drum 12. In one embodiment, print heads 18 comprise piezo electric print heads. In another embodiment, print heads 18 comprise thermal inkjet print heads. As shown by FIG. 2, print heads 18 are arranged in an arc about axis 26. As a result, print heads 18 are configured to print across a larger area of the media supported by drum 12. In the particular embodiment, drum 12 has an outer surface 30 also arranged in an arc about axis 26. Print heads 18 are arranged in an arc substantially identical to the arc in which surface 30 extends.

Carriage 20 comprises one or more structures configured to support print heads 18 in the arcuate arrangement. In addition, carriage 20 is configured to movably support print heads 18 along axis 26. Actuator 21 comprises a linear actuator configured to move carriage 20 and print heads 18 in the directions indicated by arrows 27, 28 so as to selectively position print heads 18 opposite to the media held by drum 12 or opposite to service station 22. In one embodiment, actuator 21 may comprise a motor configured to drive a toothed pulley in engagement with a toothed belt coupled to carriage 20. In another embodiment, actuator 21 may comprise other forms of a linear actuator using rack and pinion arrangements, hydraulic, pneumatic or electrical means. Although system 10 is illustrated as including five print heads supported by a single carriage 20, system 10 may alternatively include a greater or fewer number of such print heads 18 supported by one or more carriages 20. For example, in another embodiment, a separate carriage 20 may be provided for each print head 18.

Service station 22 comprises a station located on an axial end of drum 12 such that carriage 20 may position print heads 18 opposite, or adjacent, to station 22. Station 22 includes one or more components configured to perform servicing operations upon one or more of the print heads 18. As shown by FIGS. 1-3, in the particular example shown, service station 22 further includes a frame 30, supply spool 32, take-up spool 34, web drive 36, web 38, track or web support 44, lifters 46, actuator 47 caps 48 and actuator 50. Frame 30 comprises one or more walls, panels, structures, frame members and the like configured to support supply spool 32, take-up spool 34, web drive 36, web 38, track or web support 44, lifters 46, caps 48 and actuator 50 relative to drum 12.

Supply spool 32 comprises a reel configured to carry multiple windings of web 38 and to supply web 38 for use by service station 22. Take-up spool 34 comprises a reel configured to receive used windings of web 38. Web drive 36 comprise a mechanism configured to rotationally drive take-up spool 34 so as to move web 38 from spool 32 to spool 34. In one embodiment, web drive 36 may comprise motor operably coupled to spool 34 by a transmission such as a gear train, a belt and pulley arrangement or a chain and sprocket arrangement. As shown by FIG. 2, web 38 is supported by web support 44 between spools 32 and 34.

In the example illustrated, spools 32 and 34 have vertically overlapping diameters. In other words, spools 32 and 34 at least partially vertically overlap one another. In particular, spools 32 and 34 are arranged such that web 38 travels in a first direction from spool 32, travels through a U-turn and returns to spool 34 by traveling in a second direction generally opposite to the first direction. Spools 32 and 34 are located on a same side of web support 44. Because spools 32 and 34 have diameters that at least partially overlap, space is better utilized, allowing a larger amount of web 38 to be compactly stored until use. As a result, service station 22 may operate for longer periods of time without replacement of web 38. Although take-up spool 34 is illustrated as being located over supply spool 32, in other embodiments, this relationship may be reversed. In still other embodiments, spools 32 and 34 may alternatively be located on opposite sides of web support 44.

In the example illustrated, supply spool 32 is removably coupled to frame 30, allowing spool 32 to be separated from frame 30. As a result, spool 32 is only removed and replaced upon consumption of web 38. In other embodiments, spools 32 and 34 may alternatively be provided as part of a cartridge, wherein the entire cartridge is removed or swapped upon consumption of web 38.

Web 38 comprises a band or span of material for performing servicing operations upon print heads 18. In one embodiment, web is configured to interact with print heads 18 by receiving fluid, printing material or ink discharged from print heads 18. For example, in one embodiment, print heads 18 include multiple nozzles. Web 38 facilitates spitting of ink from the nozzles to clear such nozzles. In the embodiment illustrated, web 38 comprises a web of material configured to physically contact the surfaces of print heads 18 so as to wipe print heads 18. In the particular example illustrated, web 38 is also configured to contact the surfaces of print heads 18 as carriage 20 moves print heads 18 along axis 26 relative to web 38 to wipe print heads 18. In other embodiments, web 38 may additionally be configured to be moved relative to print heads 18 to perform such wiping operations. In one embodiment, web 38 comprises a web of fluid absorbent material. In one embodiment, web 38 comprises a fabric material. According to one embodiment, web 38 is formed from a fabric material such as Evolon 100 commercially available from Freudenberg Group of Germany.

In one embodiment, web 38 includes non-absorbent regions 52 separating or isolating different absorbent regions 53 from one another. Non-absorbent regions 52 inhibit migration of fluid between adjacent absorbent regions 53. Non-absorbent regions 52 inhibit migration of fluid deposited during spitting in one absorber region to other absorbent regions which are used for wiping. As a result, non-absorbent regions 52 prevent cross-contamination and increase or prolong the useful life of web 38.

As shown by FIG. 2, web support 44, schematically shown, comprises one or more structures configured to support and guide web 38 in an arc about axis 26. In the particular example shown, web support 44 is configured to support web 38 about an arc substantially similar to the arc along which print heads 18 are arranged. In one embodiment, web support 44 comprises an elongate arcuate panel or surface underlying web 38. In yet another embodiment, web support 44 comprises multiple individual surfaces that are spaced from one another in an arc. For example, in one embodiment, web support 44 may be formed from multiple rollers extending in the arc.

Web support 44 is movably coupled to frame 30 so as to move between a raised position (shown in FIGS. 1-3) for servicing print heads 18 and a retracted or lowered position (shown in FIG. 5) facilitating the capping of print heads 18. In one embodiment, web support 44 is pivotally coupled to frame 30. For example, in the embodiment illustrated, web support 44 is pivotally coupled to frame 30 about a pivot axis 51. In other embodiments, web support 44 may be pivotally coupled to frame 30 about other pivot axes. In still other embodiments, web support 44 may alternatively be configured to translate or slide between the raised position and the lowered position such as along one or more vertical tracks, channels or grooves.

In the particular example illustrated, web support 44 includes a bottom support 54 and a top cover or panel 56. Bottom support 54 extends below web 38 while top panel 56 extends over web 38 so as to sandwich and contain web 38. Top panel 56 includes windows 57 which expose portions of web 38. In other embodiments, top panel 56 may be omitted. Because web support 44 supports web 38 in an arc, web 38 may be used to simultaneously service multiple print heads 18. As shown by FIGS. 1 and 3, web 38 is supported by web support 44 over lifters 46 in an arc. As shown by FIG. 1, web 38 is exposed through windows 57. A portion of web 38 overlays lifters 46 so that web 38 may be raised into contact with print heads 18 during servicing of print heads 18.

Lifters 46 comprise mechanisms configured to lift or elevate selected portions of web 38 and to press or hold such elevated portions of web 38 against opposite portions of print heads 18 to facilitate wiping of print heads 18. In the example illustrated, each of lifters 46 includes a web backer 58 and an actuator 60. Web backer 58 comprises a structure configured to move between (1) a raised position in which web backer 58 contacts an underside of web 38 and lifts the opposing portion of web 38 to a height sufficient to contact an associated opposing print head 18 and (2) a lower position in which web 38 is spaced from print heads 18. In one embodiment, in a raised position, web backer 58 supports web 38 above web support 44 and in the lowered position allows web 38 to rest upon bottom support 54 of web support 44. In one embodiment, web Backer 58 comprises a resiliently compliant member, such as a sponge or foam member. In other embodiments, web backer 58 may have other configurations and may be formed from other materials.

Actuator 60 comprises a mechanism configured to selectively move web backer 58 between the raised and the lowered positions. In one embodiment, actuator 60 may comprise one or more cams driven by a motor or other power sources. In another embodiment, actuator 60 may comprise electric solenoids, pneumatic or hydraulic cylinder assemblies or other actuation mechanisms which directly interact with web backer 58 or which drive an intermediate cam which facilitates movement of web backer 58. In other embodiments where other mechanisms are provided for wiping of print heads 18 and where web 38 is merely used to receive fluid ejected from print heads 18, such as during spitting or purging operations, lifters 46 may be omitted.

Actuator 47 comprises a mechanism configured to move web support 44 and the supported web 38 between the raised position and the lowered position. In the raised position, web support 44 and web 38 are appropriately positioned to facilitate servicing of print heads 18. In the lowered position, web support 44 and web 38 are sufficiently retracted from print heads 18 or lowered with respect to print heads 18 to permit insertion of caps 48 between web 38 and print heads 18. Such raising and lowering of web support 44 permits caps 48 and web 38 to share vertical space, providing a more compact design and potentially enabling web 38 to be provided with an increased width. The increased width of web 38 increases the fluid absorption capacity of web 38 and enables service station 22 to operate for longer times without replacement of web 38.

In the example illustrated, actuator 47 is configured to pivot web support 44 about axis 51 between the raised position and the lowered position. In other embodiments, actuator 47 may be configured to translate or slide web support 44 between the raised position and the lowered position. In other embodiments, web support 44 may be both pivoted and translated between the raised and lowered positions.

According to one embodiment, actuator 47 may comprise one or more cams which are datumed directly to or about the rotational axis 26 of drum 12. In other words, the one or more cams of actuator 47 have surfaces that directly contact surfaces (called datum surfaces) of one or more members that define the rotational axis 26 of drum 12. The datum surfaces precisely locate the one or more cams of actuator 47 with respect to the rotational axis 26. Such cams operably engage cam followers associated with web support 44 to raise and lower web support 44. Such cams are operably coupled to a motor by a transmission such as a gear train, a belt and pulley arrangement or a chain and sprocket arrangement. Because such cams are datumed directly to the rotational axis 26 of drum 12 (shown in FIG. 1) by being directly mounted to the same structures that locates drum axis 26 and rotates about axis 26, tolerance stack may be reduced or minimized. In one embodiment, actuator 60 also comprises cams which engage cam followers associated with lift members 58, wherein the cams of actuator 60 are also datumed directly to drum axis 26, further reducing tolerance stack. In other embodiments, actuator 47 may comprise other members configured to move web support 44, such as hydraulic or pneumatic cylinder-piston assemblies, electric solenoids and the like.

Caps 48 comprise structures configured to cap or seal about fluid nozzle openings of print heads 18. Caps 48 seal about such nozzle openings when print heads 18 are not in use. Caps 48 reduce or slow drying of fluid of print heads 18 to maintain moisture about the nozzle openings of print heads 18 which enhances health of the print heads 18. In some embodiments, caps 48 may additionally be configured to provide for purging of fluid from print heads 18.

In the example illustrated, caps 48 are coupled or connected to one another so as to move in unison with one another. Caps 48 move between a first position at least partially withdrawn from over and above web support 44 (shown in FIGS. 1 and 3) and a second position over and above web support 44 to a greater extent as compared to the first position. In the example illustrated, in the first position, caps 48 are completely withdrawn from over and above web 38. In the second position, caps 48 project above and over web 38 by a distance of at least 25 mm and nominally about 38 mm in a direction along axis 26.

As noted above, caps 48 are configured to move to the second position when web support 44 is in the lowered position. Because caps 48 share space with web support 44 and web 38, servicing station 22 is more compact and web 38 may be provided with a greater width. As a result, the absorptive capacity of web 38 may be increased to increase the useful life of web 38.

In the example illustrated, caps 48 are arranged in an arc about axis 26. As a result, caps 48 may be more easily moved to the second position in which caps 48 are located between web 38 and print heads 18. In other embodiments, caps 48 may have other arrangements. In other embodiments, caps 48 may move independent of one another Actuator 50 comprises a mechanism configured to move caps 48 between the first position and the second position. In particular, actuator 50 moves caps 48 along axis 26. In one embodiment, actuator 50 is configured to additionally move caps 48 in a direction substantially perpendicular to axis 26 so as to raise caps 48 into the sealing engagement with print heads 18. In other embodiments, separate actuators may be used to raise and lower caps 48 with respect to print heads 18. In yet other embodiments, caps 48 may merely move along axis 26, wherein print heads 18 are raised and lowered with respect to caps 48 for capping of print heads 18.

In one example embodiment, actuator 50 may comprise a series of linkages and/or arms configured to receive motion or force from carriage 20 and to transmit such force or motion to caps 48 so as to move caps 48 between the first position and the second position. For example, in one embodiment, actuator 50 may be configured to be engaged by carriage 20 as print heads 18 are moved leftward as seen in FIG. 1. Actuator 50 is configured to transmit motion to caps 48 to move caps 48 rightward as seen in FIG. 1. Upon subsequent movement of carriage 20 rightward as seen in FIG. 1, caps 48 may return to the first position, moving leftward as seen in FIG. 1, under the force supplied by a bias, such as a spring. In other embodiments, actuator 50 may comprise other actuation mechanisms such as a motor and can arrangement, a hydraulic or pneumatic cylinder-piston assembly or an electric solenoid. In other embodiments, caps 48 may alternatively be configured to move along axis 26 between a first position and the second position independent of one another.

Controller 24 comprises one or more processing units configured to generate control signals directing the operation of printing system 10. Controller 24 may be associated with printer 10 or in some embodiments, may be associated with a peripheral computing device connected to printer 10. Controller 24 generates control signals directing the positioning of media by media supply 14 and rotation of drum 12 by rotary actuator 13, directing the positioning of print heads 18 through movement of carriage 20 by actuator 21, directing the ejection of fluid by print heads 18, and directing the servicing of print heads 18 at service station 22.

With respect to service station 22, controller 24 tracks operation of web drive 36 to control the supply of web 38. Controller 24 generates control signals directing operation of actuators 47 and 60 to provide spitting, wiping and capping servicing operations. Controller 24 also generates control signals directing operation of actuator 50. In some embodiments in which actuator 50 transmits motion or force received from movement of carriage 20 to caps 48, controller 24 controls positioning of caps 48 through its control of actuator 21 which moves carriage 20.

Controller 24 is coupled to rotary actuator 13, media supply 14, print heads 18, actuator 21, web drive 36, actuators 47 and 60 and actuator 50 (where applicable) in a wired fashion or in a wireless fashion. For purposes of this application, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. For example, controller 24 may be embodied as part of one or more application-specific integrated circuits (ASICs). Unless otherwise specifically noted, the controller is not limited to any specific combination of hardware circuitry and software, nor to any particular source for the instructions executed by the processing unit.

Figure 4:
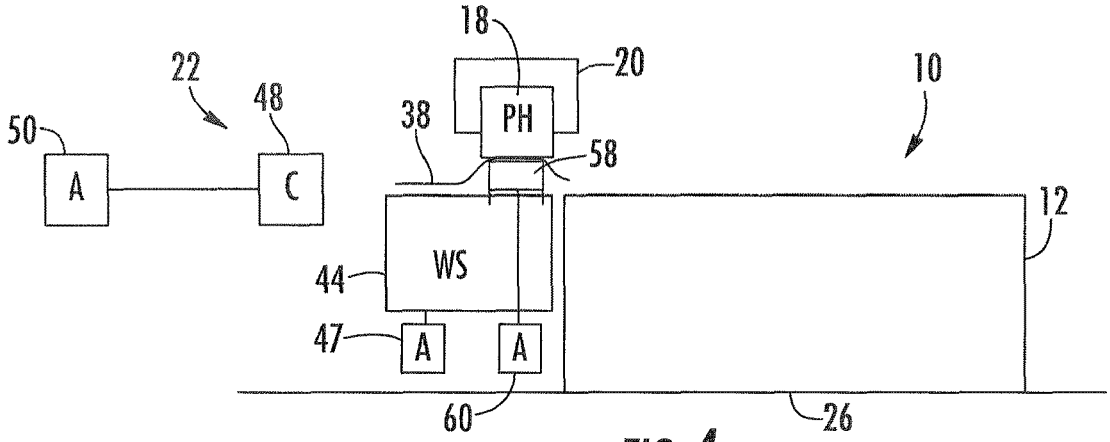
FIG. 4 is a sectional view of the printing system of FIG. 1 taken along line 3-3 illustrating wiping of print heads by the web according to an example embodiment.
Figure 5:
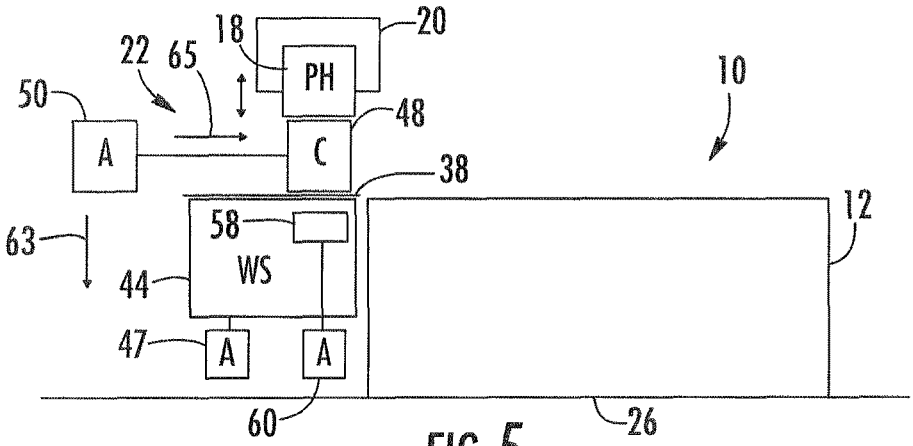
FIG. 5 is a sectional view of the printing system of FIG. 1 taken along line 3-3 illustrating capping of the print head according to an example embodiment.

FIGS. 3-5 schematically illustrate service station 22 during different servicing operations upon print heads 18 (one of which is shown). FIG. 3 illustrates service station 22 during spitting operations. As shown by FIG. 3, in response to control signal from controller 24, actuator 47 has positioned web support 44 in the raised position. At the same time, actuator 60, in response to control signal from controller 24 has lowered web backers 58 to lowered positions. Actuator 21 (shown in FIG. 1), in response to control signals from controller 24 locates carriage 20 and print heads 18 opposite to web 38. Controller 24 further generates control signals directing print heads 18 to spit fluid onto web 38. During such spitting, caps 48 are in the first position, withdrawn from over and above web 38.

FIG. 4 illustrates service station 22 during a wiping operation. During the wiping operation, web support 44 is in the raised position and caps 48 are in a first retracted position. However, as shown by FIG. 4, in response to control signal from controller 24 (shown in FIG. 1), actuators 60 move web backers 58 to raised positions in which web backers 58 lift and elevate web 38 into contact with the nozzles of print head 18 for wiping of print head 18. In one embodiment, controller 24 (shown in FIG. 1) further generates control signals directing actuator 21 (shown in FIG. 1) to translate print heads 18 relative to web backers 58 while web backers 58 are in the raised position to effectuate wiping.

FIG. 5 illustrates service station 22 in a capping operation or state. As shown by FIG. 5, controller 24 (shown in FIG. 1) generates control signals such that actuator 60 moves or maintains web backers 58 in the lowered position. Controller 24 generates control signals directing actuator 47 to move web support 44 in the direction indicated by arrow 63 to the lowered position. Web support 44 is lowered by a distance sufficient to permit one or more of caps 48 to be positioned between or sandwiched between print heads 18 and web 38. In one embodiment, web support 44 is lowered by distance equal to or greater than a height of caps 48. In one embodiment, web support 44 is lowered by distance of at least 14 mm.

As noted above, in one embodiment, actuators 47 and 60 comprise cams. In one embodiment, such cams may be supported on a single relational drive member so as to rotate with one another. Rotation of the rotational drive member by a motor or other rotational drive arrangement is controlled by controller 24, wherein different angular positions of such cams result in web backers 58 being raised or lowered and/or web support 44 being raised or lowered.

As further shown by FIG. 5, controller 24 generates control signals directing actuator 50 to move caps 48 in the direction indicated by arrow 65 from the first position shown in FIGS. 3 and 4 to the second position shown in FIG. 5. In one embodiment, caps 48 are linearly translated to the second position shown in FIG. 5.

Once caps 48 are in the second position between web 38 and print head 18, one or both of print head 18 and caps 48 are moved towards one another until caps 48 are in capping or sealing engagement with print head 18. In one embodiment, caps 48 are raised into engagement with print head 18. In one embodiment, such raising of caps 48 is also achieved by actuator 50. In embodiments where actuator 50 comprises a series of linkages, arms or cams which transmit force or motion from movement of carriage 22 so as to move caps 48, controller 24 controls the positioning of caps 48 by controlling the position of carriage 20 with actuator 21 (shown in FIG. 1).

Figure 6:
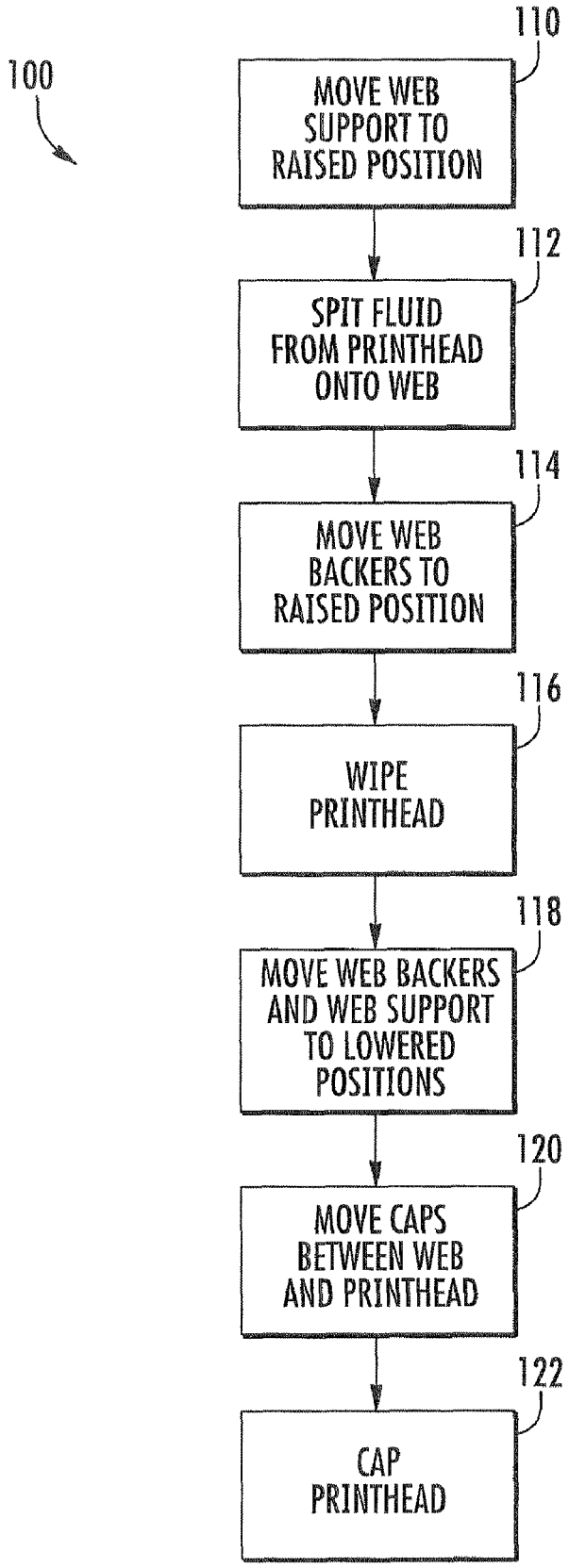
FIG. 6 is a flow diagram of a method for servicing a print head according to an example embodiment.

FIG. 6 is a flow diagram illustrating a method 100 of servicing print heads 18. As indicated by step 110, web support 44 is moved to the raised position (shown in FIG. 3). If web support 44 is already in the raised position, such movement may be omitted. As indicated by step 112 and also shown by FIG. 3, fluid, such as ink, is spit or otherwise ejected from print head 18 onto web 38. Such spitting is schematically represented by arrows 113 in FIG. 3. Such spitting clears nozzles of print heads 18.

As indicated by step 114 and shown in FIG. 4, web backers 58 are moved to their raised positions. As noted above, such movement results in web 38 being moved or pressed against print head 18. As indicated by step 116, print heads 18 are wiped. In particular, carriage 20 is moved so as to move print heads 18 relative to web 38 and web supports 58 while web 38 is in contact with print heads 18. During such wiping, before such wiping or after completion of wiping, controller 24 may generate control signals directing web drive 36 (shown in FIG. 2) to advance web 38 to present a fresh or clean portion of web 38 opposite to print head 18 for current wiping or subsequent wiping operations.

As indicated by step 118 and shown in FIG. 5, web backers 58 and web support 44 are both lowered to their lowered positions. In the embodiment illustrated, prior to such lowering, caps 48 have a height greater than the spacing between web 38 and print heads 18 which would otherwise inhibit positioning of caps 48 between print heads 18 and web 38. As indicated by step 120, caps 48 are moved between web 38 and print head 18. Caps 38 are moved to a positions opposite to and in substantial alignment with print head 18 such that sealing portions of caps 48 surround nozzle openings (not shown) of print heads 18. As indicated by step 122, print heads 18 are capped. In particular, print heads 18 and caps 48 are moved into sealing engagement with one another. In one embodiment, caps 48 are raised into engagement with nozzle faces of print head 18.

Figure 7:
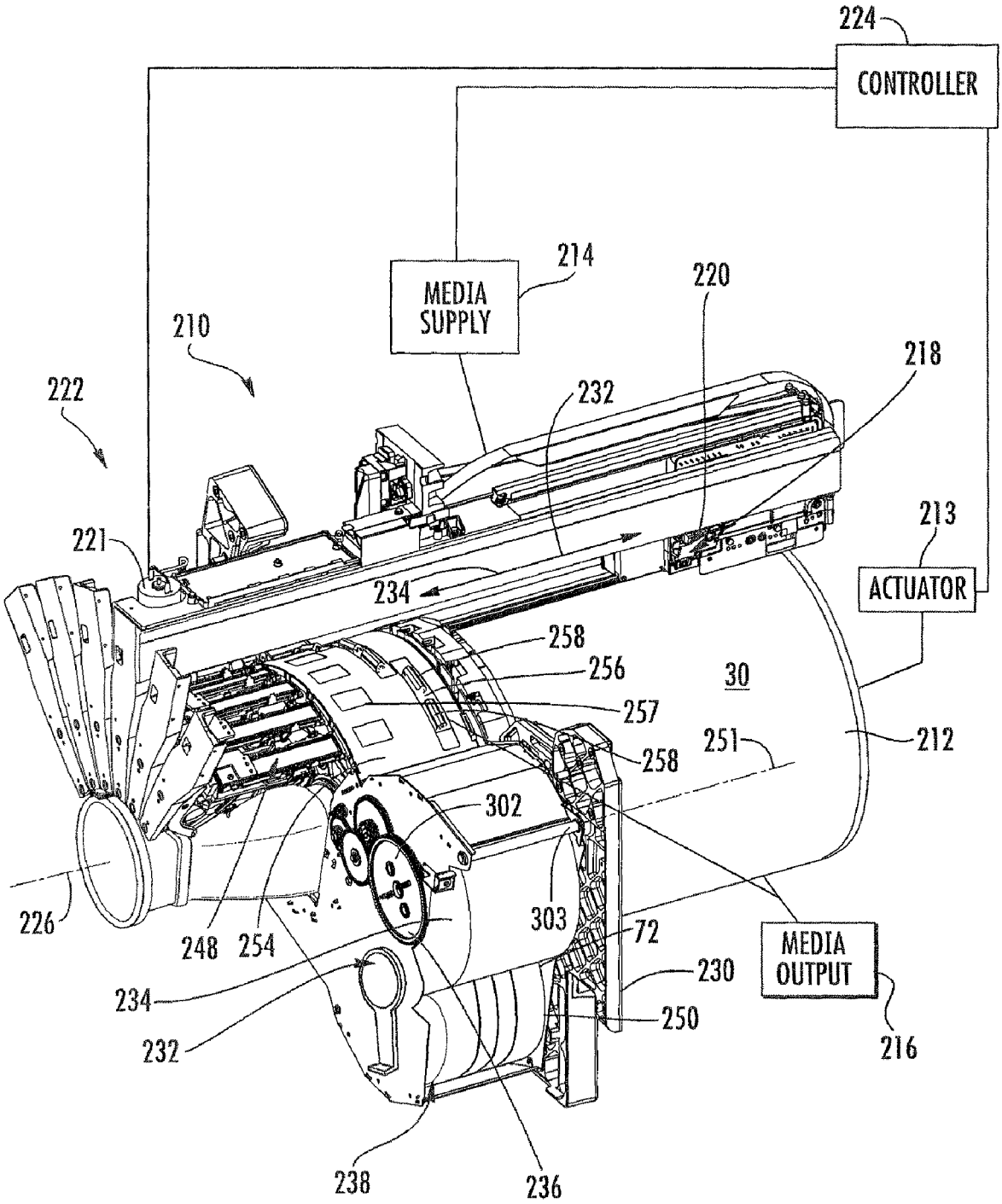
FIG. 7 is a perspective view of another embodiment of the printing system of FIG. 1 according to an example embodiment.
Figure 8:
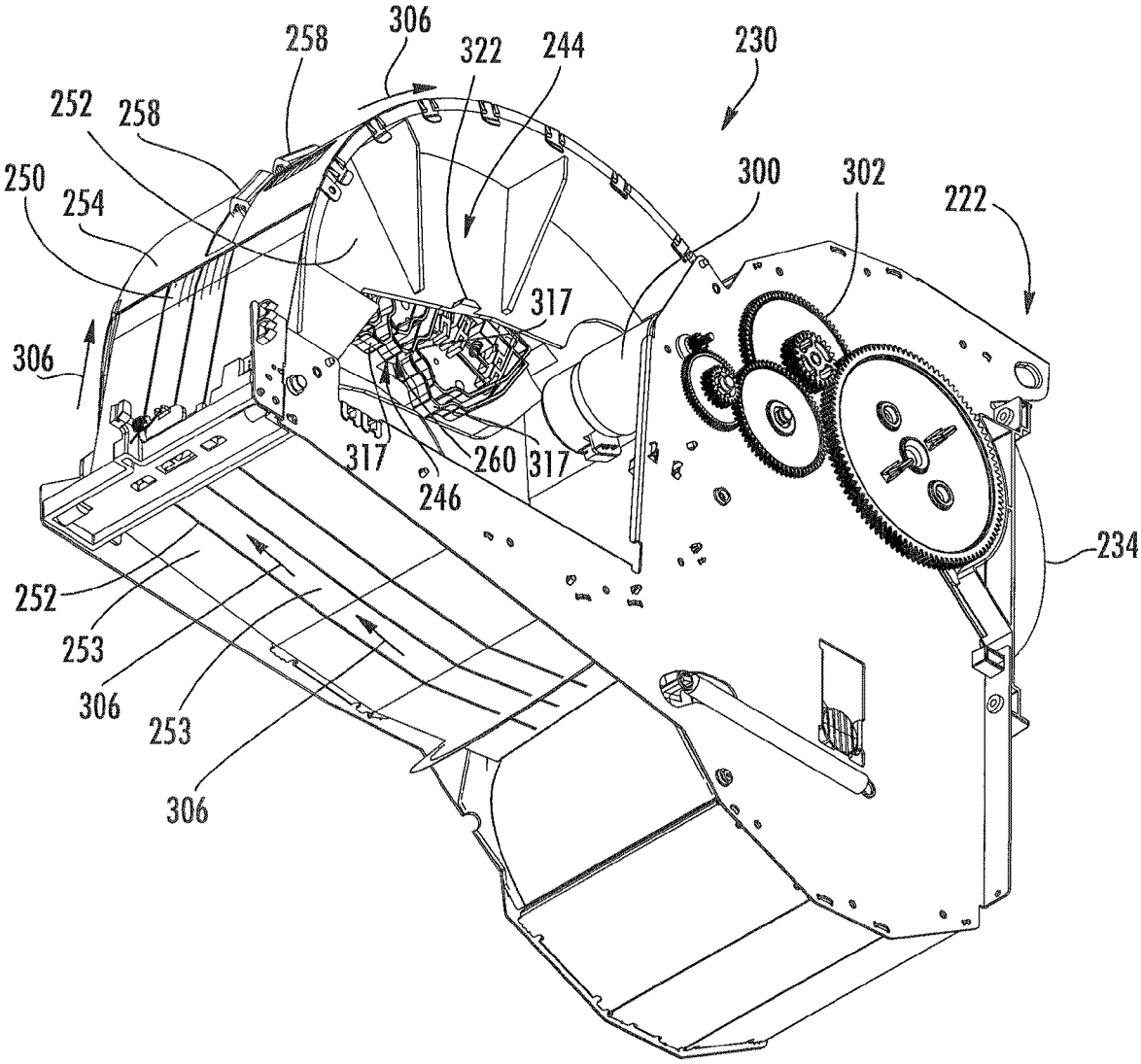
FIG. 8 is a bottom perspective view of a service station of the printing system of FIG. 7 according to an example embodiment.
Figure 9:
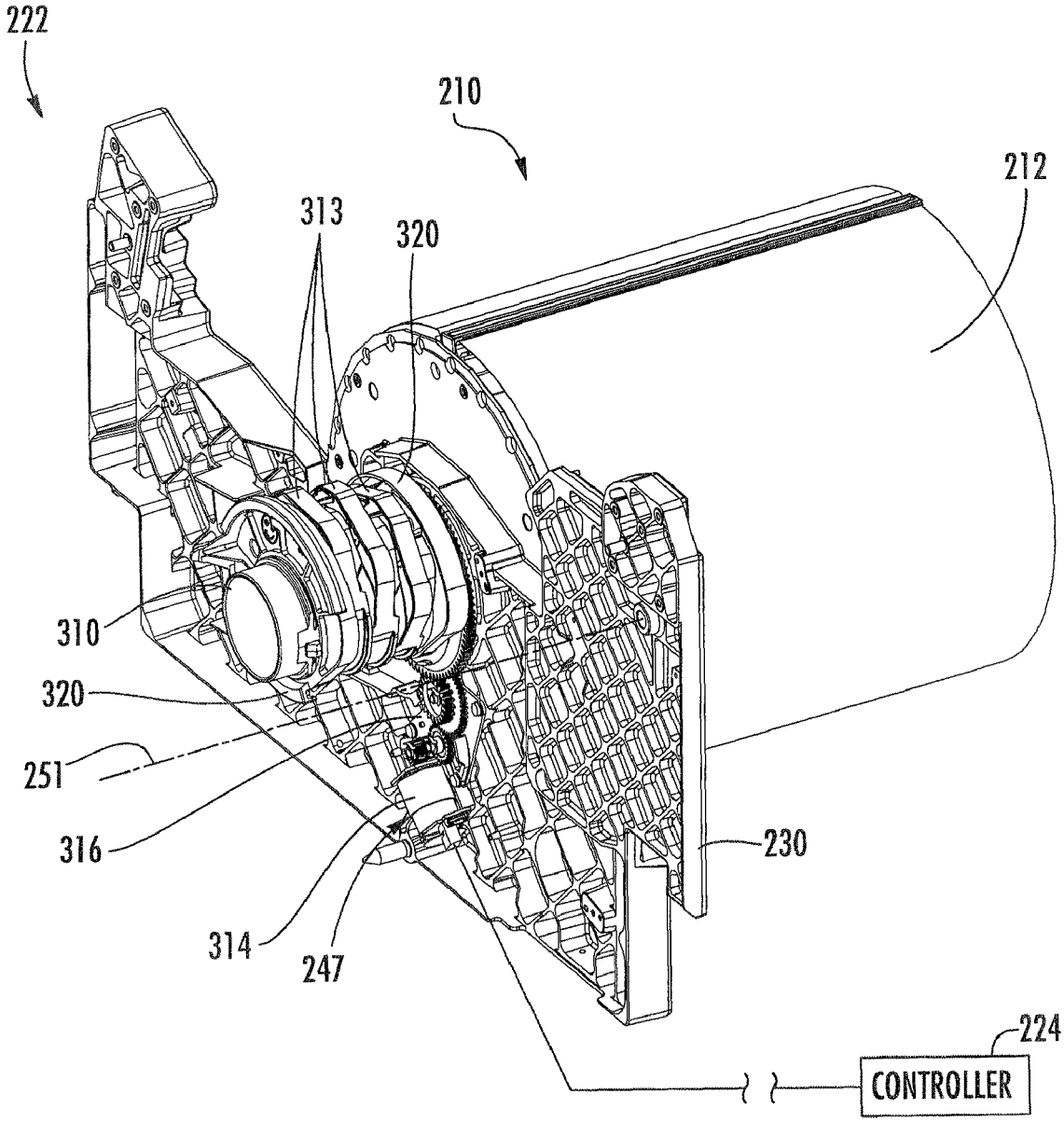
FIG. 9 is a top perspective view of a portion of the printing system of FIG. 7 according to an example embodiment.

FIGS. 7-9 illustrate printing system 210, another embodiment of printing system 10 shown in FIG. 1. Printing system 210 generally includes drum 212, rotary actuator 213, media supply 214, media output 216, print heads 218 (one of which is shown), carriages 220 (one of which is shown), actuators 221 (one of which is shown) service station 222 and controller 224 (shown in FIGS. 7 and 9). Drum 212 generally comprises an elongated cylinder configured to be rotatably driven about axis 226 by rotary actuator 213 while transporting media, such as paper, about axis 226 relative to print heads 218. Rotary actuator 213, schematically shown, comprises a source of torque, such as a motor, operably coupled to drum 212 by a transmission (not shown).

Media supply 214, schematically shown, comprises a mechanism configured to supply media to drum 212. In one embodiment, media supply 214 comprises a mechanism configured to pick an individual sheet of media from a stack of media and to supply the individual sheet to drum 212 such that the sheet is wrapped at least partially about drum 212. Media output 216, schematically shown, comprises a mechanism configured to withdraw printed upon media from drum 212 and to transport withdrawn media to and contain withdrawn media within an output tray, bin or the like.

Print heads 218 comprise print heads configured to dispense imaging material, such as ink, upon the medium held by drum 212. In one embodiment, print heads 218 comprise piezo electric print heads. In another embodiment, print heads 218 comprise thermal inkjet print heads. Print heads 218 are arranged in an arc about axis 226. As a result, print heads 218 are configured to print across a larger area of the media supported by drum 212. In the particular embodiment, drum 212 has an outer surface 230 also arranged in an arc about axis 226. Print heads 218 are arranged in an arc substantially identical to the arc in which surface 230 extends.

Carriage 220 comprises one or more structures configured to support print heads 218 in the arcuate arrangement. In addition, carriage 220 is configured to movably support print heads 218 along axis 226. Actuator 221 comprises a linear actuator configured to move carriage 220 and print heads 218 so as to selectively position print heads 218 opposite to the media held by drum 212 or opposite to service station 222. In one embodiment, actuator 221 may comprise a motor (not shown) configured to drive a toothed pulley in engagement with a toothed belt coupled to carriage 220. In another embodiment, actuator 221 may comprise other forms of a linear actuator using rack and pinion arrangements, hydraulic, pneumatic or electrical means. Although only one print head 218, carriage 220 and actuator 221 is shown, in the example illustrated, system 210 includes 6 print heads supported by 6 carriages, wherein each print head 218 is independently moved or actuated by a dedicated actuator 221. In other embodiments, a single carriage may move each of the multiple print heads in unison with one another. In other embodiments, system 210 may alternatively include a greater or fewer of such print heads 218 supported by one or more carriages 220 and driven by one or more actuators 221.

Service station 222 comprises a station located on an axial end of drum 212 such that carriages 220 may position print heads 218 opposite, or adjacent, to station 222. Station 222 includes one or more components configured to perform servicing operations upon one or more of the print heads 218. As shown by FIG. 8, in the particular example shown, service station 222 includes a frame 230, supply spool 232, take-up spool 234, web drive 236, web 238, track or web support 244, lifters 246, actuator 260, caps 248 and actuator 250. Frame 230 comprises one or more walls, panels, structures, housing members and the like configured to support supply spool 232, take-up spool 234, web drive 236, web 238, track or web support 244, lifters 246, caps 248 and actuator 250 relative to drum 212.

Supply spool 232 comprises a reel configured to carry multiple windings of web 238 and to supply web 238 for use by service station 222. Take-up spool 234 comprises a reel configured to receive used windings of web 238. Web drive 236 comprises a mechanism configured to rotationally drive take-up spool 234 so as to move web 238 from spool 232 to spool 234. In the embodiment illustrated, web drive 236 comprises a motor 300 (shown in FIG. 8) operably coupled to spool 234 by a transmission 302 comprising a gear train. In other embodiments, transmission 302 may comprise a belt and pulley arrangement or a chain and sprocket arrangement. As shown by FIG. 8, web 238 is supported by web support 244 between spools 232 and 234.

In the example illustrated, spools 232 and 234 have vertically overlapping diameters. In other words, spools 232 and 234 at least partially vertically overlap one another. In particular, spools 232 and 234 are arranged such that web 238 travels in a first direction from spool 232, travels through a U-turn and returns to spool 234 by traveling in a second direction generally opposite to the first direction. Spools 232 and 234 are located on a same side of web support 244. Because spools 232 and 234 have diameters at least partially overlap, is better utilized, allowing a larger amount of web 238 to be compactly stored until use. As a result, service station 222 may operate for longer periods of time without replacement of web 238. Although take-up spool 234 is illustrated as being located over supply spool 232, in other embodiments, this relationship may be reversed. In still other embodiments, spools 232 and 234 may alternatively be located on opposite sides of web support 244.

In the example illustrated, supply spool 232 is removably coupled to frame 230, allowing spool 232 to be separated from frame 230. As a result, spool 232 is only removed and replaced upon consumption of web 238. In other embodiments, spools 232 and 234 may alternatively be provided as part of a cartridge, wherein the entire cartridge is removed or swapped upon consumption of web 238.

Web drive 236 comprises a mechanism configured to drive one or both of supply spool 232 or take-up spool 234 so as to move web 238 across web support 244 and across windows 257. Web drive 236 drives web 238 over web backers 258. In the example illustrated, web drive 236 comprises a transmission, such as the set of drive gears shown, connected to the take-up spool 234 and operably coupled to motor 300 (shown in FIG. 8). Torque supplied by the motor 300 drives take-up spool 234 to pull web 238 from supply roll or spool 232 about web support 244 to take-up spool 234 as indicated by arrows 306 in FIG. 8. In other embodiments, web drive 236 may have other configurations.

Web 238 comprises a band or span of material for performing servicing operations upon print heads 218. In one embodiment, web is configured to interact with print heads 218 by receiving fluid, printing material or ink discharged from print heads 218. For example, in one embodiment, print heads 218 include multiple nozzles (not shown). Web 238 facilitates spitting of ink from the nozzles to clear such nozzles. In the embodiment illustrated, web 238 comprises a web of material configured to physically contact the surfaces of print heads 218 so as to wipe print heads 218. In the particular example illustrated, web 238 is also configured to contact the surfaces of print heads 218 as carriage 220 moves print heads 218 along axis 226 relative to web 238 to wipe print heads 218. In other embodiments, web 238 may additionally be configured to be moved relative to print heads 218 to perform such wiping operations. In one embodiment, web 238 comprises a web of fluid absorbent material. In one embodiment, web 238 comprises a fabric material. According to one embodiment, web 238 is formed from a fabric material such as Evolon 100 commercially available from Freudenberg Group of Germany.

In one embodiment, web 238 includes non-absorbent regions 252 separating or isolating different absorbent regions 253 from one another. Non-absorbent regions 252 inhibit migration of fluid between adjacent absorbent regions 253. Non-absorbent regions 252 inhibit migration of fluid deposited during spitting in one absorber region to other absorbent regions which are used for wiping. As a result, non-absorbent regions 252 prevent cross-contamination and increase or prolong the useful life of web 238.

As shown by FIG. 8, web support 244 comprises one or more structures configured to support web 238 in an arc about axis 226. In the particular example shown, web support 244 is configured to support web 238 about an arc substantially similar to the arc along which print heads 218 are arranged. In the example illustrated, web support 244 includes web guide 252 and web cover 254. Web guide 252 comprises an elongate arcuate panel or surface underlying web 238. In yet another embodiment, guide 252 comprises multiple individual surfaces that are spaced from one another in an arc. For example, in one embodiment, guide 252 may be formed from multiple rollers extending in the arc.

Web cover 254 extends over web 238 so as to sandwich and contains web 238. As shown by FIG. 7, web cover 254 includes windows 256, 257 which expose portions of web 238. In particular, windows 256 expose those portions of web 238 opposite to web backers 258. In the example illustrated, web cover 252 includes three such windows 256, wherein each window 256 exposes two web backers 258 for performing wiping operations on two of print heads 218.

Windows 257 expose those portions of web 238 which are to receive fluid ejected or spit from print heads 218. In the example illustrated, web cover 254 includes a separate window arcuately arranged about axis 226 for each of print heads 218. In other embodiments, window 256 may comprise a continuous window through which fluid from more than one print head 218 may be ejected onto web 238. In other embodiments, web cover 254 may have other configurations or may be omitted.

Figure 10:
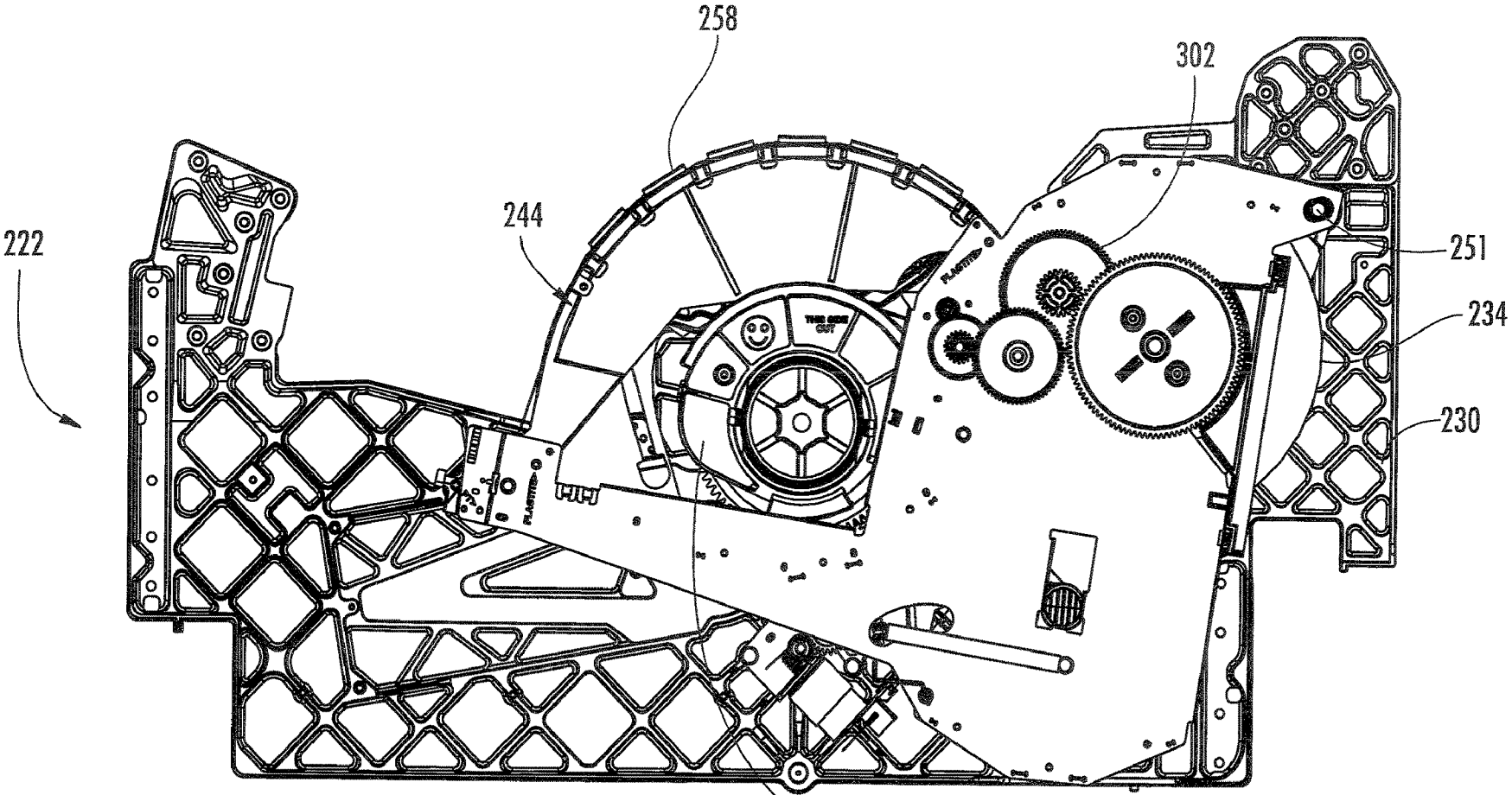
FIG. 10 is a side elevational view of a web support of the printing system of FIG. 7 in a raised position according to an example embodiment.

Web support 244 is movably coupled to frame 230 so as to move between a raised position (shown in FIG. 7) for servicing print heads 218 and a retracted or lowered position (shown in FIG. 10) facilitating the capping of print heads 218. In the example illustrated, web support 244 is pivotably coupled to frame 230 at hinge 303 for pivotal movement about pivot axis 251. In other embodiments, web support 244 may be pivotably coupled to frame 230 about other pivot axes. In still other embodiments, web support 244 may alternatively be configured to translate or slide between the raised position and the lowered position such as along one or more vertical tracks, channels or grooves.

Actuator 260 comprises a mechanism configured to selectively move web backer 258 between the raised and lowered positions. In one embodiment, actuator 260 may comprise one or more cams driven by a motor or other power sources. In another embodiment, actuator 260 may comprise electric solenoids, pneumatic or hydraulic cylinder assemblies or other actuation mechanisms which directly interact with web backer 258 or which drive an intermediate cam which facilitates movement of web backer 58. In other embodiments where other mechanisms are provided for wiping of print heads 218 and where web 238 is merely used to receive fluid ejected from print heads 218, such as during spitting or purging operations, lifters 246 may be omitted.

Lifters 246 comprise mechanisms configured to lift or elevate selected portions of web 238 and to press or hold such elevated portions of web 238 against opposite portions of print heads 218 to facilitate wiping of print heads 218. In the example illustrated, each of lifters 246 includes a web backer 258 and an actuator 260. Web backer 258 comprises a structure configured to move between (1) a raised position in which web backer 258 contacts an underside of web 238 and lifts the opposing portion of web 238 to a height sufficient to contact an associated opposing print head 218 and (2) a lowered position in which web 238 is spaced from print heads 218. In one embodiment, in a raised position, web backer 258 supports web 238 above web support 244 and in the lowered position allows web 238 to rest upon web support 244.

Actuators 260 comprise mechanisms configured to selectively move web backers 258 between the raised and lowered positions. As shown by FIG. 8, actuators 260 include datum 310, lift cams 313, cam drive motor 314 and transmission 316. Datum 310 comprises a structure against which cams 312 are datumed (precisely positioned). In the example illustrated, datum 310 comprises a duct centered about axis 226, the same axis about which drums 212 rotates. Because cams 212 are datumed (precisely positioned in space and with respect to other structures) directly to the rotational axis 226 of drum 212 by being directly mounted to datum 310 that locates drum axis 226, tolerance stack may be reduced or minimized.

Lift cams 313 are each operably coupled to an associated web backer 258 having an associated cam follower surface 317. Lift cams 313 are operably coupled to drive motor 314 by transmission 316. Selective rotation of cams 313 by motor 314 raises and lowers backers 258 between the raised and lowered positions.

In another embodiment, actuator 260 may comprise electric solenoids, pneumatic or hydraulic cylinder assemblies or other actuation mechanisms which directly interact with web backers 258 or which drive an intermediate cam which facilitates movement of web backer 258. In other embodiments where other mechanisms are provided for wiping of print heads 218 and where web 238 is merely used to receive fluid ejected from print heads 218, such as during spitting or purging operations, lifters 246 may be omitted.

FIGS. 8-11 illustrates actuator 260 in more detail. Actuator 260 comprises a mechanism configured to move web support 244 and the supported web 38 between the raised position and the lowered position. In the raised position, web support 244 and web 238 are positioned to facilitate servicing of print heads 218. In the lowered position, web support 244 and web 238 are sufficiently retracted from print heads 218 or lowered with respect to print heads 218 to permit insertion of caps 248 between web 238 and print heads 218. Such raising and lowering of web support 244 permits caps 248 and web 238 to share vertical space, providing a more compact design and potentially enabling web 38 to provide it with an increased width. The increased width of web 238 increases the fluid absorption capacity of web 238 and enables service station 222 to operate for longer times without replacement of web 238.

Figure 11:
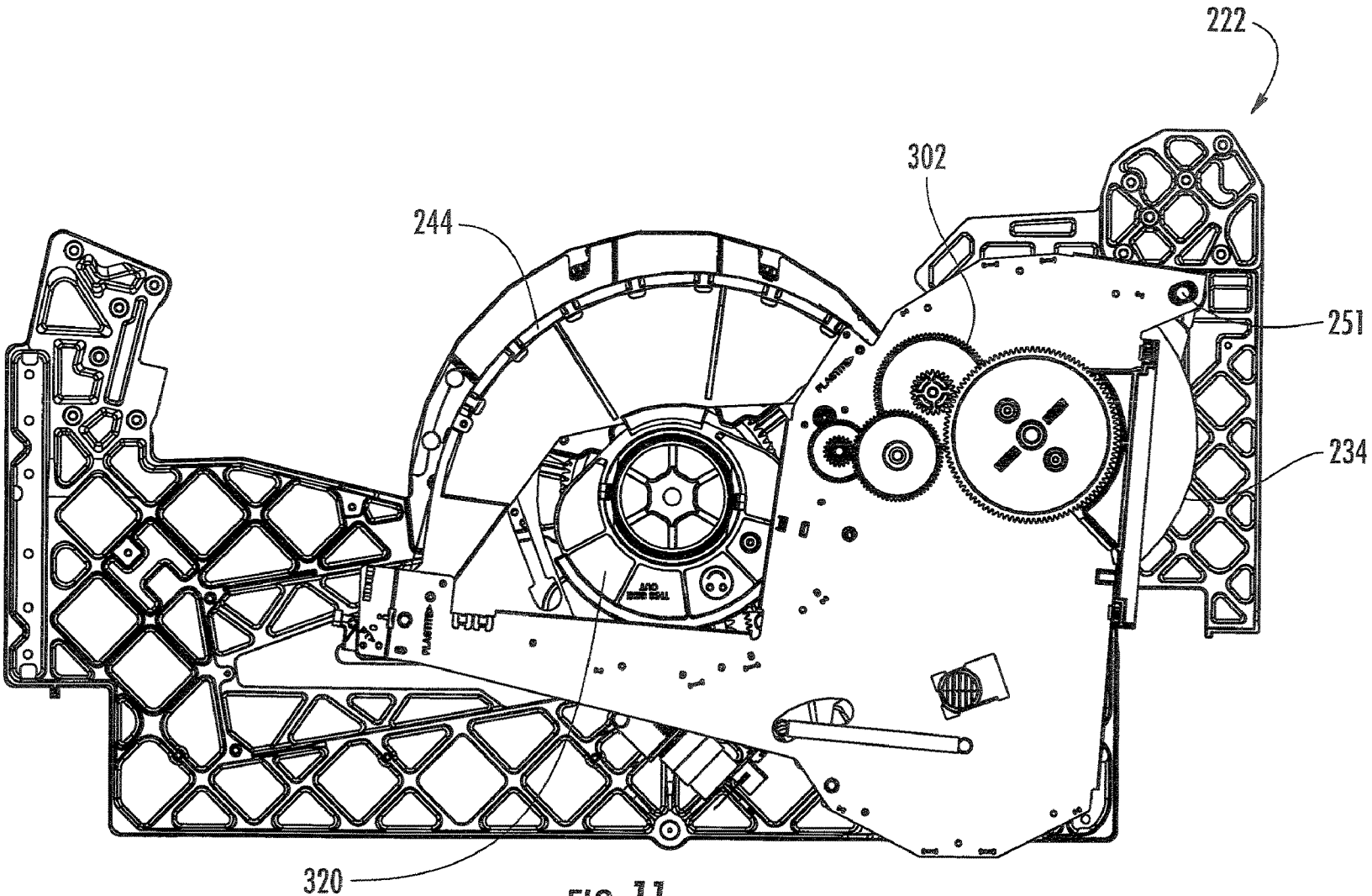
FIG. 11 is a side elevational view of a web support of the printing system of FIG. 7 in a lowered position according to an example embodiment.

In the example illustrated, actuator 260 is configured to pivot web support 244 about axis 251 between the raised position (shown in FIG. 10) and the lowered position (shown in FIG. 11). In the example illustrated, actuator 260 pivots web support 244 in at least about 5 degrees such that those portions of web support 244 opposite to that print heads and closest to the pivot point of web support 244 are raised or lowered through a distance of approximately 14 mm and such at those portions of web support 244 opposite to the print heads and farthest from the pivot point of web support 244 are raised or lowered through a distance of approximately 40 mm. In other embodiments, actuator 260 may be configured to translate or slide web support 244 between the raised position and the lowered position. In other embodiments, web support 244 may be both pivoted and translated between the raised and lowered positions.

As shown by FIG. 9, in the embodiment illustrated, actuator 260 comprises datum 310, web support lift cams 320 (also known as service station lift cams or web module lift cams), cam drive motor 314 and transmission 316. Datum 310 comprises a structure against which cams 312 are datumed (precisely positioned). In the example illustrated, datum 310 comprises a duct centered about axis 226, the same axis about which drums 212 rotates. Because cams 320 are located with respect to the rotational axis 226 of drum 212 by being directly mounted to datum 310 that locates drum axis 226, tolerance stack may be reduced or minimized.

Cams 320 comprise cam structures configured to rotate about datum 310 and to engage corresponding cam follower surfaces 322 (shown in FIG. 8) coupled to and carried by web support 244. Cams 320 are irregularly shaped such that rotation of cams 320 against opposite associated cam followers connected to web support 244 pivot web support 244 about axis 251 to raise and lower web support 244 between the raised and lowered positions, depending upon the angular positioning of cams 320.

Drive motor 314 applies torque to cams 312 via transmission 316. In the example illustrated, transmission 316 comprises a gear train. In other embodiments, transmission 316 may comprise a chain and sprocket arrangement or a belt and pulley arrangement. Drive motor 314 rotate cams 312 to move web support 244 between the raised position and the lowered position. Because actuator 260 and actuators 260 of lifters 246 utilize a same drive motor 247, a same transmission 316 and a same datum 310, complexity is reduced and compactness is increased. In other embodiments, actuator 260 and actuators 260 may utilize independent motors, independent transmissions and independent datums.

As shown by FIG. 7, Caps 248 comprise structures configured to cap or seal about fluid nozzle openings of print heads 218. Caps 248 seal about such nozzle openings when print heads 218 are not in use. Caps 248 maintain a moist environment about print heads 218 to maintain the health of the print heads 218. In some embodiments, caps 248 may additionally be configured to provide for purging of fluid from print heads 218.

In the example illustrated, caps 248 are coupled or connected to one another such a move in unison with one another. Caps 248 move between a first position at least partially withdrawn from over and above web support 244 (shown in FIG. 7) and a second position over and above web support 244 to a greater extent as compared to the first position (shown in FIG. 10). In the example illustrated, in the first position, caps 248 are completely withdrawn from over and above web 238. In the second position, caps 248 project above and over web 238 by a distance of at least 25 mm and nominally about 38 mm in a direction along axis 226.

As noted above, caps 248 are configured to move to the second position when web support 244 is in the lowered position. Because caps 248 share space with web support 244 and web 238, servicing station 222 is more compact and web 238 may be provided with a greater width. As a result, the absorptive capacity of web 238 may be increased to increase the useful life of web 238.

In the example illustrated, caps 48 are arranged in an arc about axis 226. As a result, caps 248 may be more easily moved to the second position in which caps 248 are located between web 238 and print heads 218. In other embodiments, caps 248 may have other arrangements.

Figure 12:
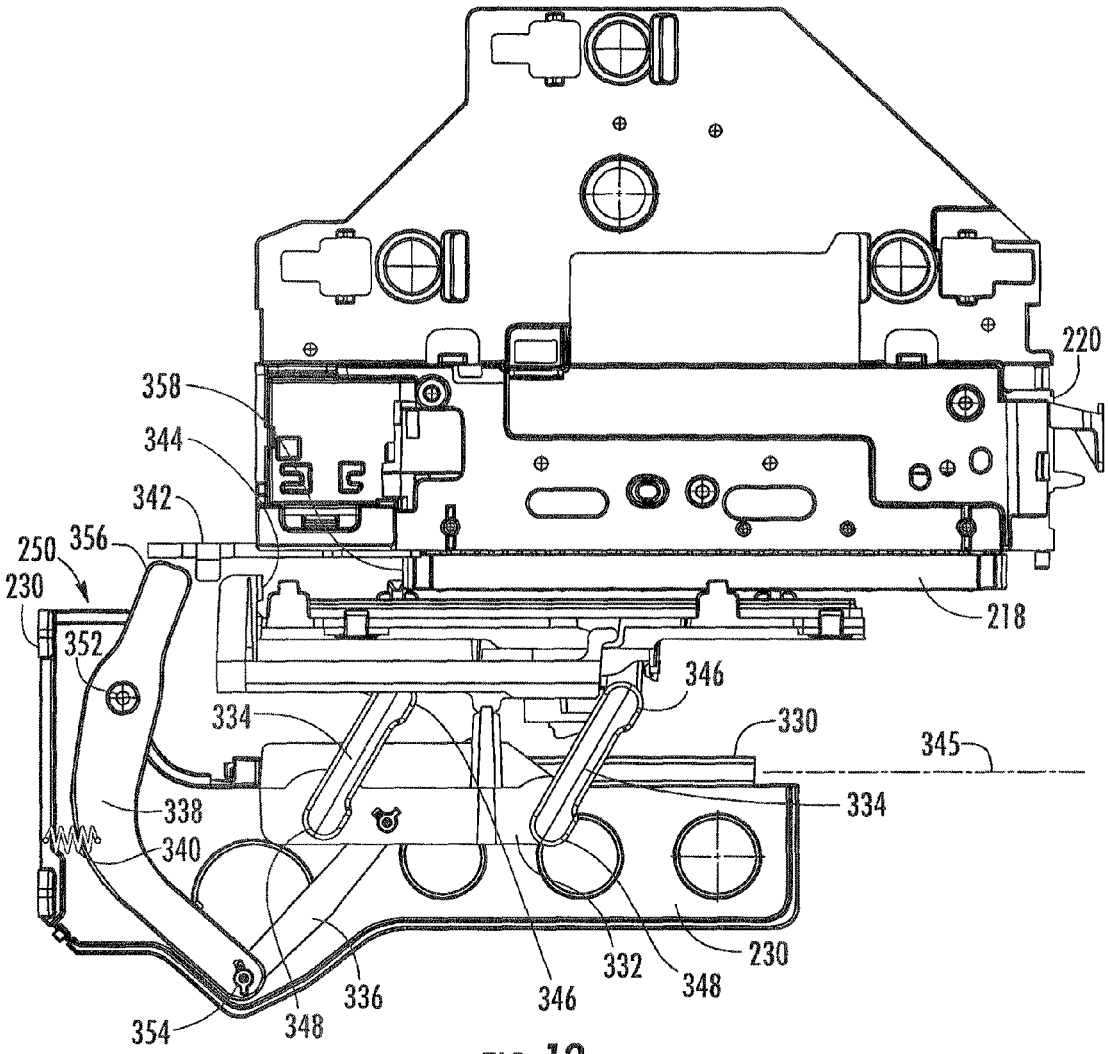
FIG. 12 is a side elevational view of a cap of the printing system of FIG. 7 in a first retracted position according to an example embodiment.
Figure 13:
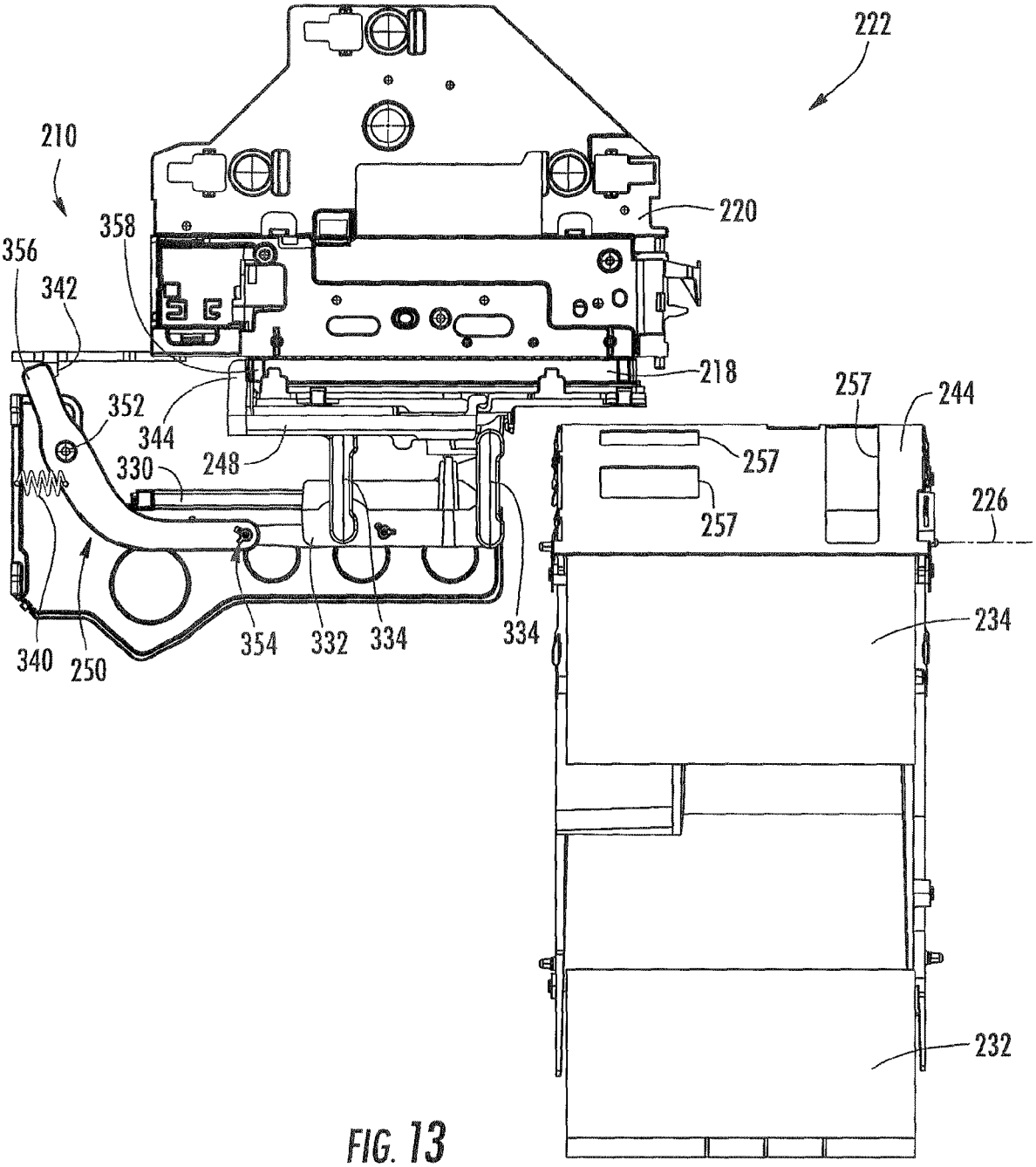
FIG. 13 is a side elevational view of the printing system of FIG. 7 with the cap in a second extended position according to an example embodiment.

Actuator 250 comprises a mechanism configured to move caps 48 between the first position (shown in FIG. 12) and the second position (shown in FIG. 13). In particular, actuator 250 moves caps 248 along axis 226 (shown in FIG. 7). In one embodiment, actuator 250 is configured to additionally move caps 248 in a direction substantially perpendicular to axis 226 so as to raise caps 248 into the sealing engagement with print heads 218. In other embodiments, separate actuators may be used to raise and lower caps 248 with respect to print heads 218. In yet other embodiments, caps 248 may merely move along axis 226, wherein print heads 18 are raise and lowered with respect to caps 248 for capping of print heads 218.

FIGS. 12 and 13 illustrate one example of actuator 250 in detail. FIG. 12 illustrates actuator 250 with caps 248 in the first retracted position. FIG. 13 illustrates actuator 250 with caps 248 in the second extended position. As shown by FIG. 12, actuator 250 includes a slider guide 330, slider 332, cap links 334, slider link 336, arm 338, bias 340, carriage ram 342 and cap tab 344. Slider guide 330 comprises one or more structures supported by frame 230 and configured to guide translation of slider 332 along axis 345. In the example illustrated, slider guide 330 comprises one or more grooves, tracks or channels in which paper programs for not shown) extending from slider 332 is received and slides. In other embodiments, slider guide 330 may have other configurations.

Slider 332 (also known as a sled or carriage) comprises a member configured to slide along slider guide 330 along axis 345. Slider 332 is pivotally connected to cap links 334 and slider link 336. Slider 332 may have a variety of shapes and configurations.

Cap links 334 comprise elongate linkages extending between slider 332 and caps 248. Cap links 334 each have a first end 346 pivotally connected to one or more of caps 248 and a second and 348 pivotally connected to slider 332. Cap links 334 cooperate with slider 332 and caps 248 to form a four-bar linkage. This four-bar linkage facilitates vertical raising and lowering of caps 248 as will be described hereafter.

Slider link 336 comprises a linkage having opposite ends pivotally connected to slider 332 and arm 338. Arm 338 comprises an elongate member pivotally coupled to frame 230 about axis 352. Arm 338 has a first end 354 pivotally connected to link 336 and a second end 356 on an opposite side of axis 352 that is configured to being engaged and directly contacted by carriage ram 342.

Bias 340 comprises one or more bias members configured to resiliently bias arm 338 towards clockwise angular rotation about pivot axis 352 as seen in FIG. 12. Bias 340 resiliently biases end 356 to the right as seen in FIG. 12 and resiliently biases end 354 as well as slider 332 and caps 348 to the left as seen in FIG. 12. In the example illustrated, bias 340 comprises a tension spring having a first end connected to frame 230 and a second end connected to arm 338 between axis 352 and end 354. In other embodiments, bias 340 may comprise other bias structures, such as other types of springs, at other locations.

Carriage ram 342 comprises a structure coupled to carriage 220 so as to move with carriage 220. Carriage ram 342 is configured so as to engage end 356 of arm 338 to pivot arm 338 about axis 352 and a counter-clockwise direction against the bias of the bias 340. Although illustrated as a downwardly projecting tab, carriage ram 342 may have a variety of sizes, shapes, configurations and locations.

Cap tab 344 comprises a protrusion or projection extending from one or more of caps 348 which are configured to be contacted, abutted or driven by carriage 220 when print heads 218 are substantially aligned over caps 248. In the example illustrated, cap tab 344 is configured to contact and to be driven by edge 358 of the print head 218. As shown in FIG. 13, when print head 218 engages and drives 344, both ends of links 334 pivot to vertically lift or raise caps 348 into sealing engagement with print heads 218. In other embodiments, other stop surfaces or friction clutches at the pivot point of links 334 may be utilized to cause links 334 to pivot from the tilted position shown in FIG. 12 to the substantially vertical position shown a FIG. 13 so as to raise caps 248.

Controller 224 is similar to controller 24 (shown in FIG. 1). Controller 224 comprises one or more processing units configured to generate control signals directing the operation of printing system 210. Comptroller 224 may be associated with printer 210 or in some embodiments, maybe associated with a peripheral computing device connected to printer 210. Controller 224 generates control signals directing the positioning of media by media supply 214 and rotation of drum 212 by rotary actuator 213, directing the positioning of print heads 218 through movement of carriage 220 by actuator 221, directing the ejection of fluid by print heads 18, and directing the servicing of print heads 218 at service station 222.

With respect to service station 222, controller 224 tracks operation web drive 236 to control the supply of web 238. Controller 224 generates control signals directing operation of actuators 260 and 260 to provide spitting, wiping and capping servicing operations. Controller 224 also generates control signals directing operation of actuator 250. In the embodiment illustrated in which actuator 250 transmits motion or force received from movement of carriage 220 to caps 248, controller 224 controls positioning of caps 248 through its control of actuator 221 which moves carriage 220. Controller 224 is coupled to rotary actuator 213, media supply 214, print heads 218, actuator 221, web drive 236, actuators 260 and actuator 250 (where applicable) in a wired fashion or in a wireless fashion.

Figure 14:
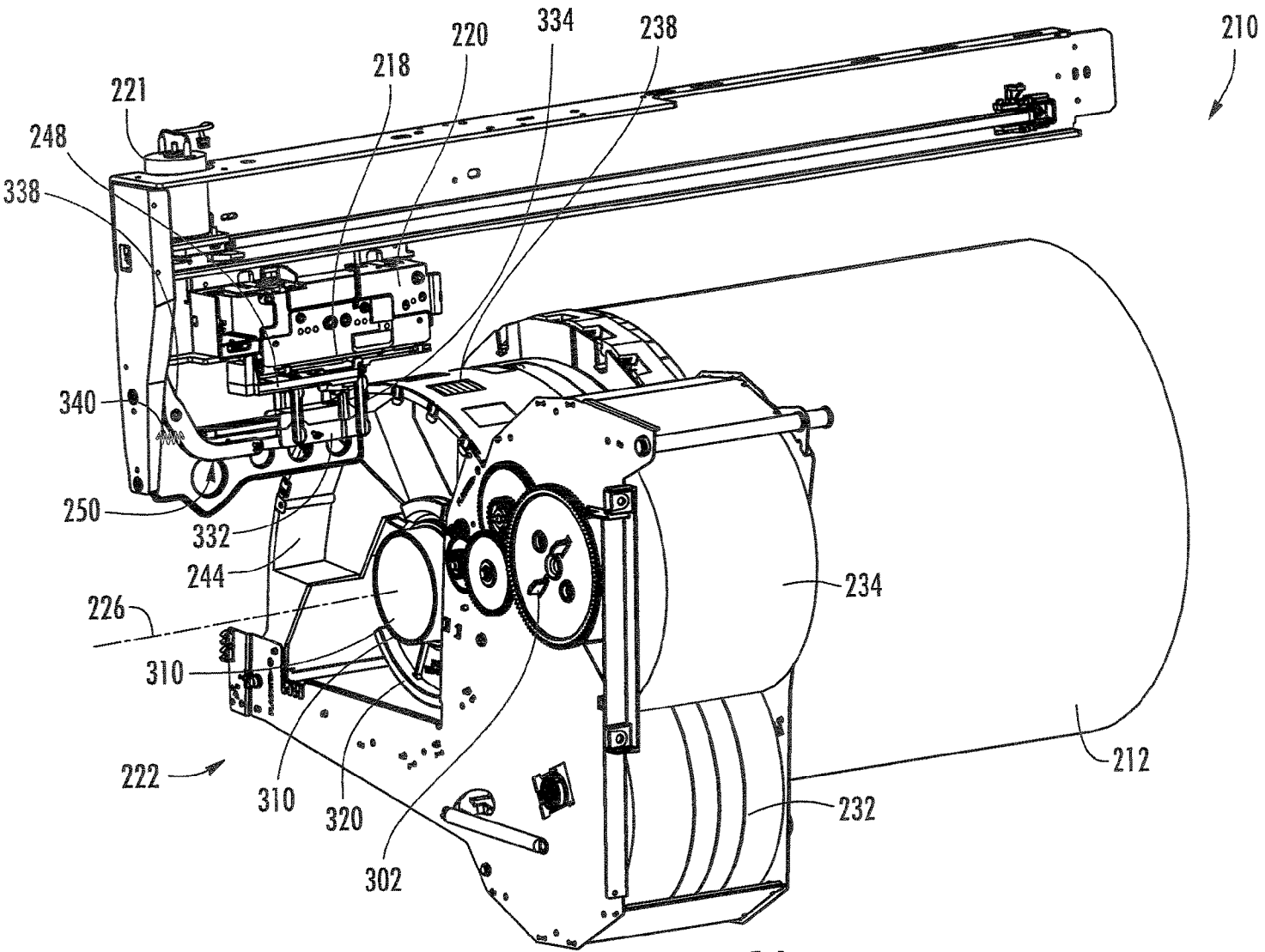
FIG. 14 is a perspective view of the printing system of FIG. 7 with the web support in the lowered position and the cap in the second extended position according to an example embodiment.

In contrast to FIG. 7, which illustrates web support 244 and web 238 in the raised position and illustrates caps 248 in the first retracted position, FIG. 14 illustrates web support 244 and web 238 in the lowered position and illustrates caps 248 in the second extended position at least partially over web 238. To achieve this state, controller 224 generates control signals directing motor 314 to rotate cams 322 lower web support 244 and web 238 from the raised position shown in FIG. 10 to the lowered position shown in FIG. 11. Controller 224 further generates control signals directing actuator 221 to drive and translate carriage 220 from the first position shown in FIG. 12 is to the capping position shown FIG. 13. During this translation of carriage 220, carriage ram 342 first contacts end 356 of arm 338. Continued movement of carriage 220 to the left (as seen in FIG. 12) pivots arm 338 about axis 352 to drive slider 332 to the right as seen in FIG. 12. Movement of slider 332 to the right results in caps 248 also being moved to the right as seen in FIG. 12 from the first position to the second position in which caps 248 least partially overlie web 238. During such translation to the right, links 334 are in the orientation shown in FIG. 12. Upon caps 248 and print heads 218 moving into alignment with one another (caps 248 moving to the right and print heads 218 moving to the left as seen in FIG. 13) edge 358 of print heads 218 contacts tab 344. As a result, slider 248 moves to the right relative to caps 248 so as to pivot links 334 in a counter-clockwise direction as seen in FIG. 13. This results in caps 248 being vertically lifted into closer sealing engagement with print heads 218. Because caps 248 move in a substantially horizontal path followed by a substantially vertical path, horizontal translation of caps 248 while in contact with printed several 218 is reduced or eliminated. As a result, a better sealing alignment is achieved with reduced wear to either print heads 218 or caps 248. As noted above, because caps 248 share space with the underlying web 238 and web support 244, service station 222 is more compact and a width of web 238 may be increased for greater absorptive and wiping capacity.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An apparatus comprising:

a web support movable between a raised position for servicing a print head and a lowered position; and;

a cap configured to cap the print head, wherein the cap is movable, while the web support is in the lowered position, between a first position at least partially withdrawn from over and above the web support and a second position over and above the web support to a greater extent as compared to the first position.

2. The apparatus of claim 1 further comprising a web supported by the web support, wherein the cap is at least partially withdrawn from over and above the web in the first position and extends over and above the web to a greater extent in the second position as compared to the first position.

3. The apparatus of claim 1, wherein the web support pivots between the raised positioned and the lowered position.

4. The apparatus of claim 1, wherein the web support is configured to support a web in an arc opposite to one or more print heads.

5. The apparatus of claim 1 further comprising a drum configured to support print media being printed upon, the drum having a rotational axis, wherein the web support is located against a structure defining the axis.

6. The apparatus of claim 1 further comprising a supply spool and a take-up spool for a web supported by the web support.

7. The apparatus of claim 6, wherein the supply spool and the take-up spool have vertically overlapping diameters.

8. The apparatus of claim 1 further comprising a drum configured to support print media being printed upon, the drum having a central axis, the apparatus further comprising a web lift cam configured to lift a web relative to the support, wherein the web lift cam located against a structure defining the central axis.

9. The apparatus of claim 1, wherein the cap is configured to move along a first axis between the first position and the second position and wherein the cap is configured to move along a second axis substantially perpendicular to the first axis between a capped position in capping engagement with the print head and an uncapped position spaced from the print head.

10. A method comprising:

moving a web support and supported web to a raised position;

servicing a print head with the web while the web is in the raised position;

moving the web support and the web to a lowered position;

moving a cap from a first position at least partially withdrawn from over and above the web to a second position over and above the web to a greater extent as compared to the first position; and capping the print head while the cap is in the second position.

11. The method of claim 10, wherein the cap is moved along a first axis from the first position to the second position and wherein capping the print head while the cap is in the second position includes moving the cap along a second axis substantially perpendicular to the first axis to a capping position in capping engagement with the print head.

12. The method of claim 10, wherein moving the web support and the web comprises pivoting the web support.

13. The method of claim 10, wherein servicing the print head comprises wiping the print head.

14. The method of claim 10 further comprising spitting fluid from the print head onto the web while the web is in the lowered position.

15. The method of claim 10, wherein servicing the print head comprises moving the web substantially perpendicular to the web support between a wiping position in engagement with the print head and a spitting position withdrawn from the print head.

* * * * *